US012352275B2

(12) United States Patent
Gambhir

(10) Patent No.: US 12,352,275 B2
(45) Date of Patent: Jul. 8, 2025

(54) FAN ASSEMBLY

(71) Applicant: TECHTRONIC CORDLESS GP, Anderson, SC (US)

(72) Inventor: Venkat Praveen Gambhir, Greenville, SC (US)

(73) Assignee: Techtronic Cordless GP, Anderson, SC (US)

( * ) Notice: Subject to any disclaimer, the term of this patent is extended or adjusted under 35 U.S.C. 154(b) by 0 days.

(21) Appl. No.: 18/296,758

(22) Filed: Apr. 6, 2023

(65) Prior Publication Data

US 2024/0337268 A1 Oct. 10, 2024

(51) Int. Cl.

| | |
|---|---|
| ***F04D 25/06*** | (2006.01) |
| ***F04D 19/00*** | (2006.01) |
| ***F04D 29/52*** | (2006.01) |
| ***F04D 29/70*** | (2006.01) |

(52) U.S. Cl.

CPC ..... *F04D 25/0673* (2013.01); *F04D 19/002* (2013.01); *F04D 29/522* (2013.01); *F04D 29/703* (2013.01)

(58) Field of Classification Search

CPC .... F04D 29/703; F04D 29/522; F04D 29/601; F04D 19/002; F04D 25/0673; F04D 25/08; F04D 29/646; F04D 29/263; F04D 29/541; F04D 25/166; F04D 29/34; F04D 29/54; F04D 29/626; F04D 29/4226

See application file for complete search history.

(56) References Cited

U.S. PATENT DOCUMENTS

| | | | | |
|---|---|---|---|---|
| 3,871,795 | A * | 3/1975 | Habdo | F04D 29/626 417/361 |
| 5,441,391 | A * | 8/1995 | Frost | F04D 19/002 417/362 |
| 6,257,440 | B1 * | 7/2001 | Perkins | A45C 13/26 220/760 |
| 6,585,489 | B2 * | 7/2003 | Perella | F04D 29/703 416/247 R |
| 9,863,698 | B1 * | 1/2018 | Turner | F04D 17/162 |
| 2007/0280829 | A1 * | 12/2007 | Stevens | F04D 29/164 416/189 |
| 2012/0269663 | A1 * | 10/2012 | Kamiya | F04D 25/0673 417/411 |

(Continued)

OTHER PUBLICATIONS

Screen captures from YouTube clip entitled "SIP | 05681 DEWALTÂ® DXF2475 24" Drum Fan", uploaded Feb. 26, 2021 by user SIP Industrial Products. Retrieved from <https://youtu.be/7zaQwGeS-pk?si=hz87uz1-dziYAYSE> (Year: 2021).*

*Primary Examiner* — Dominick L Plakkoottam

(74) *Attorney, Agent, or Firm* — Michael Best & Friedrich LLP

(57) ABSTRACT

A fan assembly includes a motor having an output shaft that defines a rotation axis, a plurality of fan blades coupled to the output shaft and configured to be rotated by the output shaft when the motor is actuated to generate airflow, a fan shroud surrounding the plurality of fan blades, and a handle disposed on the fan shroud. The handle comprises a base and a rotating handle structure rotatable about the base. The base includes a first gripping portion configured to be gripped by a user, and the rotating handle structure includes a second gripping portion configured to be gripped by the user.

4 Claims, 11 Drawing Sheets

(56) References Cited

U.S. PATENT DOCUMENTS

| | | | | |
|---|---|---|---|---|
| 2015/0108363 | A1* | 4/2015 | Kanazawa | F04D 29/005 417/234 |
| 2018/0215025 | A1* | 8/2018 | Marks | B25C 5/06 |
| 2019/0309758 | A1* | 10/2019 | Ediger | F04D 29/541 |
| 2019/0383295 | A1* | 12/2019 | Eggers | F04D 29/601 |
| 2022/0080437 | A1* | 3/2022 | Zhong | B05B 9/03 |
| 2022/0290680 | A1* | 9/2022 | Metcalf | F04D 29/703 |
| 2022/0290693 | A1* | 9/2022 | Spaulding | F04D 25/08 |
| 2023/0118363 | A1* | 4/2023 | Zhong | F04D 19/002 |

* cited by examiner

FAN ASSEMBLY

FIELD

The present disclosure relates generally to a fan assembly.

BACKGROUND

There are various cooling devices for cooling an area and/or users. One such device is a fan, which generally include spinning fan blades that produce airflow for cooling the area and/or user.

SUMMARY

Aspects and advantages of one or more embodiments of the invention in accordance with the present disclosure will be set forth in part in the following description, may be understood from the description, or may be learned through practice of the technology.

According to one or more embodiments, a fan assembly comprises a motor having an output shaft that defines a rotation axis, a plurality of fan blades coupled to the output shaft and configured to be rotated by the output shaft when the motor is actuated to generate airflow, a fan shroud surrounding the plurality of fan blades, and a handle disposed on the fan shroud, wherein the handle comprises a base and a rotating handle structure rotatable about the base, and wherein the base comprises a first gripping portion configured to be gripped by a user, and the rotating handle structure comprises a second gripping portion configured to be gripped by the user.

According to one or more embodiments, the fan assembly defines an upward direction and a downward direction, and the handle is disposed on the fan shroud at a position in the upward direction from the rotation axis.

According to one or more embodiments, the fan assembly defines a rightward direction and a leftward direction, the handle is disposed on the fan shroud at a position in one of the rightward direction and the leftward direction from the rotation axis, and at least one wheel is positioned in the downward direction from the rotation axis and the other of the rightward and leftward direction from the rotation axis.

According to one or more embodiments, the first gripping portion and the second gripping portion extend in a direction parallel to the rotation axis.

According to one or more embodiments, the rotating handle structure is rotatable between a lowered position and a raised position, in the lowered position, the first gripping portion and the second gripping portion are equidistant from the rotation axis, and, in the raised position, the second gripping portion is farther away from the rotation axis than the first gripping portion.

According to one or more embodiments, the rotating handle structure is rotatable between a lowered position and a raised position, and the handle comprises a detent structure configured to retain the rotating handle structure in the raised position.

According to one or more embodiments, the detent structure comprises a rib disposed on one of the rotating handle structure and the base, and a detent slot disposed on the other of the rotating handle structure and the base and, in the raised position, the rib is inserted into detent slot.

According to one or more embodiments, a fan assembly comprises a motor having an output shaft that defines a rotation axis, a plurality of fan blades coupled to the output shaft and configured to be rotated by the output shaft when the motor is actuated to generate airflow, a fan shroud surrounding the plurality of fan blades, a battery receptacle assembly disposed on the fan shroud, wherein the battery receptacle assembly comprises a battery receptacle configured to receive a battery pack, wherein the fan assembly defines an upward direction and a downward direction, and wherein the battery receptacle is disposed in the downward direction from the rotation axis.

According to one or more embodiments, the fan assembly comprises a stand, and the battery receptacle assembly is directly fixed to the stand.

According to one or more embodiments, two wheels are rotatably disposed on the stand, and the battery receptacle is at least partially disposed between the two wheels.

According to one or more embodiments, the battery receptacle assembly comprises an electrical plug receptacle.

According to one or more embodiments, the battery receptacle assembly comprises a speed control dial that is rotatable to control a rotational speed of the motor.

According to one or more embodiments, the speed control dial is disposed in the upward direction from the battery receptacle.

According to one or more embodiments, the battery receptacle comprises a guide rail portion configured to accept a slidable battery pack in a direction that forms an angle with the upward direction and the downward direction.

According to one or more embodiments, a fan assembly comprises a motor having an output shaft that defines a rotation axis, a plurality of fan blades coupled to the output shaft and configured to be rotated by the output shaft when the motor is actuated to generate airflow, a fan shroud surrounding the plurality of fan blades, and a rear grill disposed on a rear side of the fan shroud, wherein the plurality of fan blades define a fan diameter, wherein each of the plurality of fan blades defines a leading edge and a trailing edge, and wherein a ratio between i) a minimum distance between the trailing edge of each of the plurality of fan blades and the rear grill and ii) the fan diameter is 10% or greater.

According to one or more embodiments, the ratio is between 10% and 18%.

According to one or more embodiments, the ratio is between 15% and 18%.

According to one or more embodiments, the ratio is between 16% and 17%.

According to one or more embodiments, the fan assembly further comprises a front grill, and the minimum distance between the trailing edge of each of the plurality of fan blades and the rear grill is greater than a minimum distance between the trailing edge of each of the fan blades and the front grill.

According to one or more embodiments, the fan assembly further comprises a front grill, and the minimum distance between the trailing edge of each of the plurality of fan blades and the rear grill is greater than a minimum distance between the leading edge of each of the fan blades and the front grill.

These and other features, aspects and advantages of one or more embodiments of the present invention will become better understood with reference to the following description and appended claims. The accompanying drawings, which are incorporated in and constitute a part of this specification, illustrate embodiments of the technology and, together with the description, serve to explain the principles of the technology.

DETAILED DESCRIPTION

Figure 1:
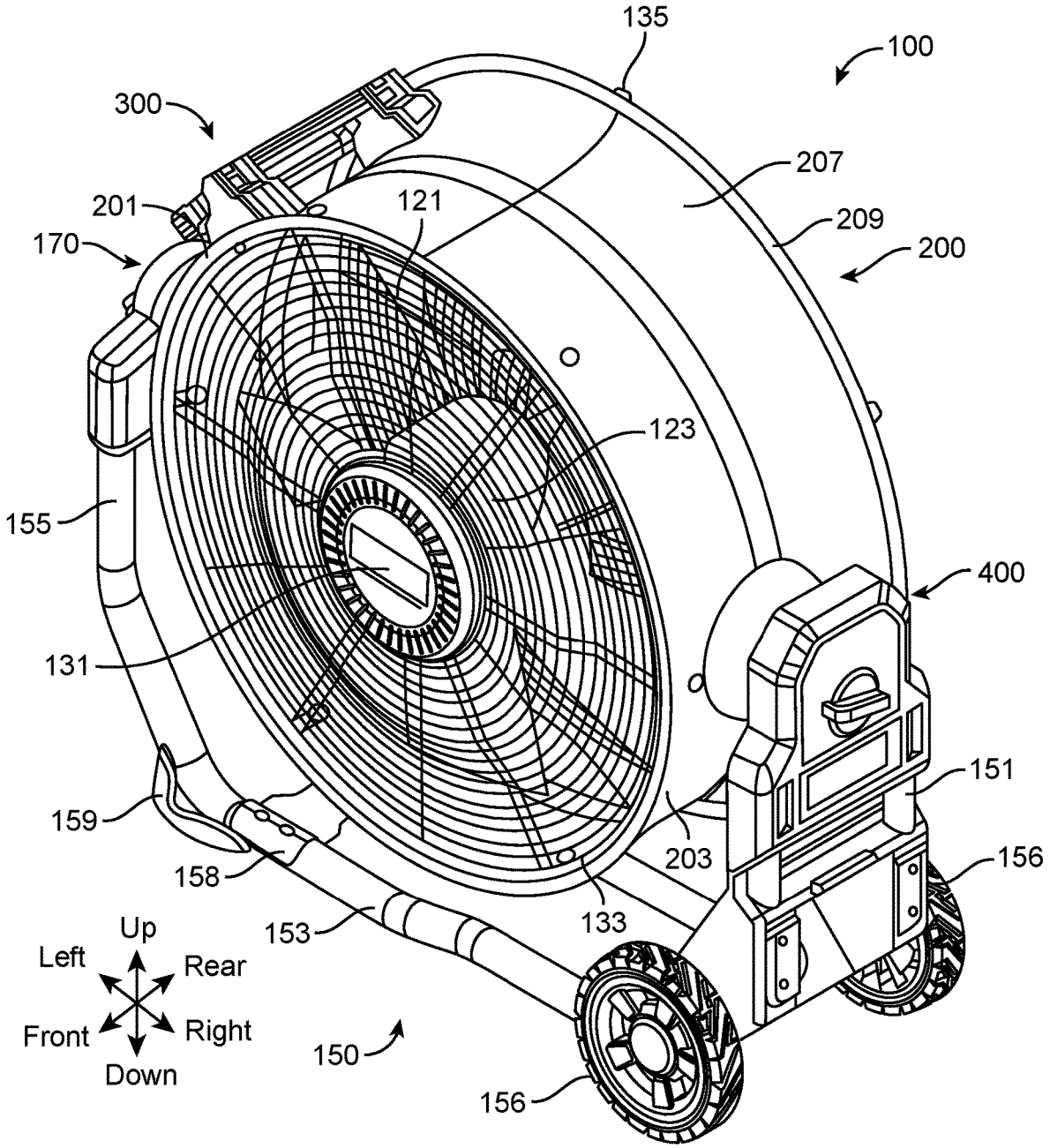
FIG. 1 shows a front perspective view of a fan assembly according to one or more embodiments.

Reference now will be made in detail to embodiments of the present invention, one or more examples of which are illustrated in the drawings. The word "exemplary" is used herein to mean "serving as an example, instance, or illustration." Any implementation described herein as "exemplary" is not necessarily to be construed as preferred or advantageous over other implementations. Moreover, each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Terms of approximation, such as "about," "generally," "approximately," or "substantially," include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

Figure 2:
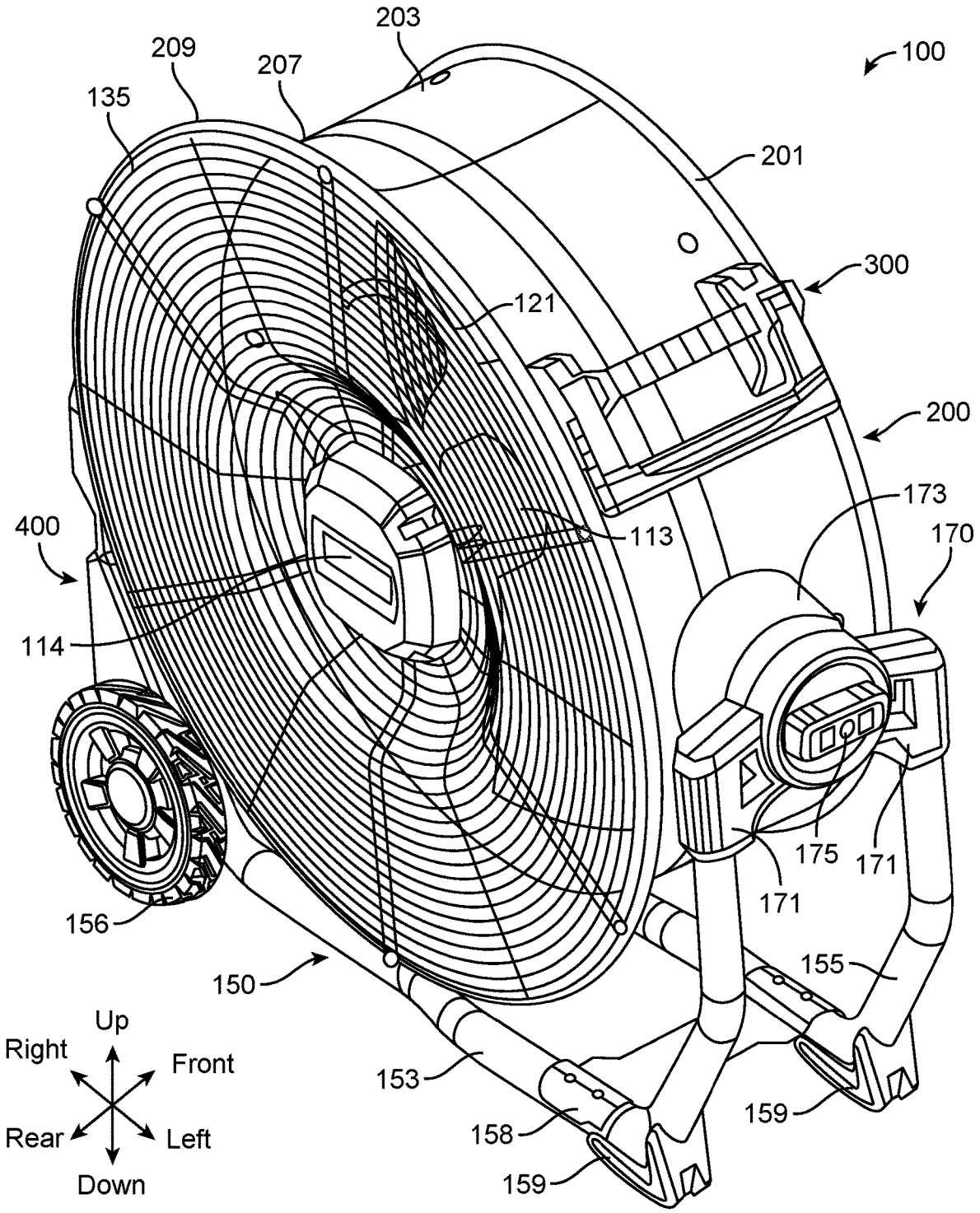
FIG. 2 shows a rear perspective view of a fan assembly according to one or more embodiments.
Figure 3:
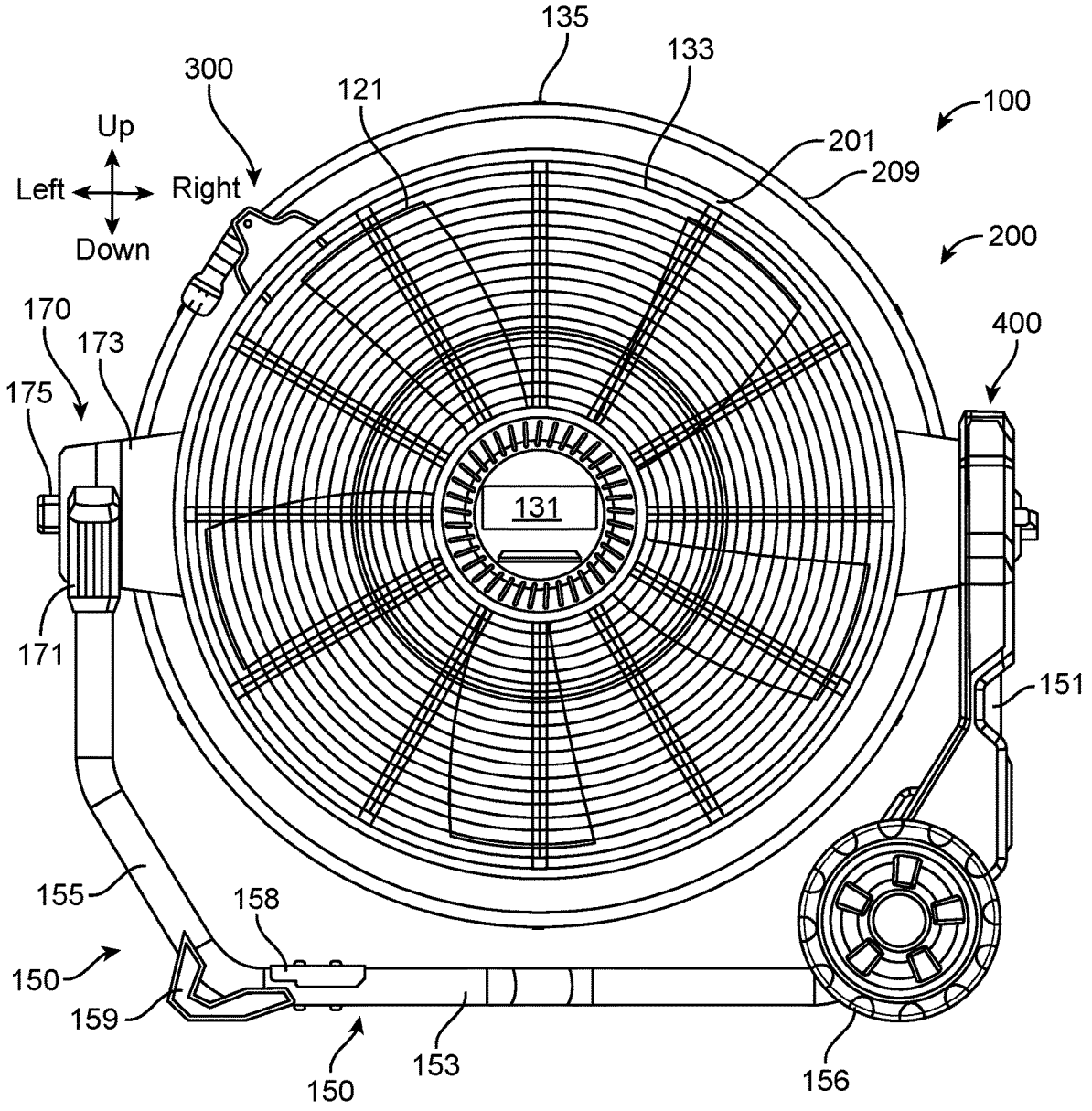
FIG. 3 shows a front view of a fan assembly according to one or more embodiments.
Figure 4:
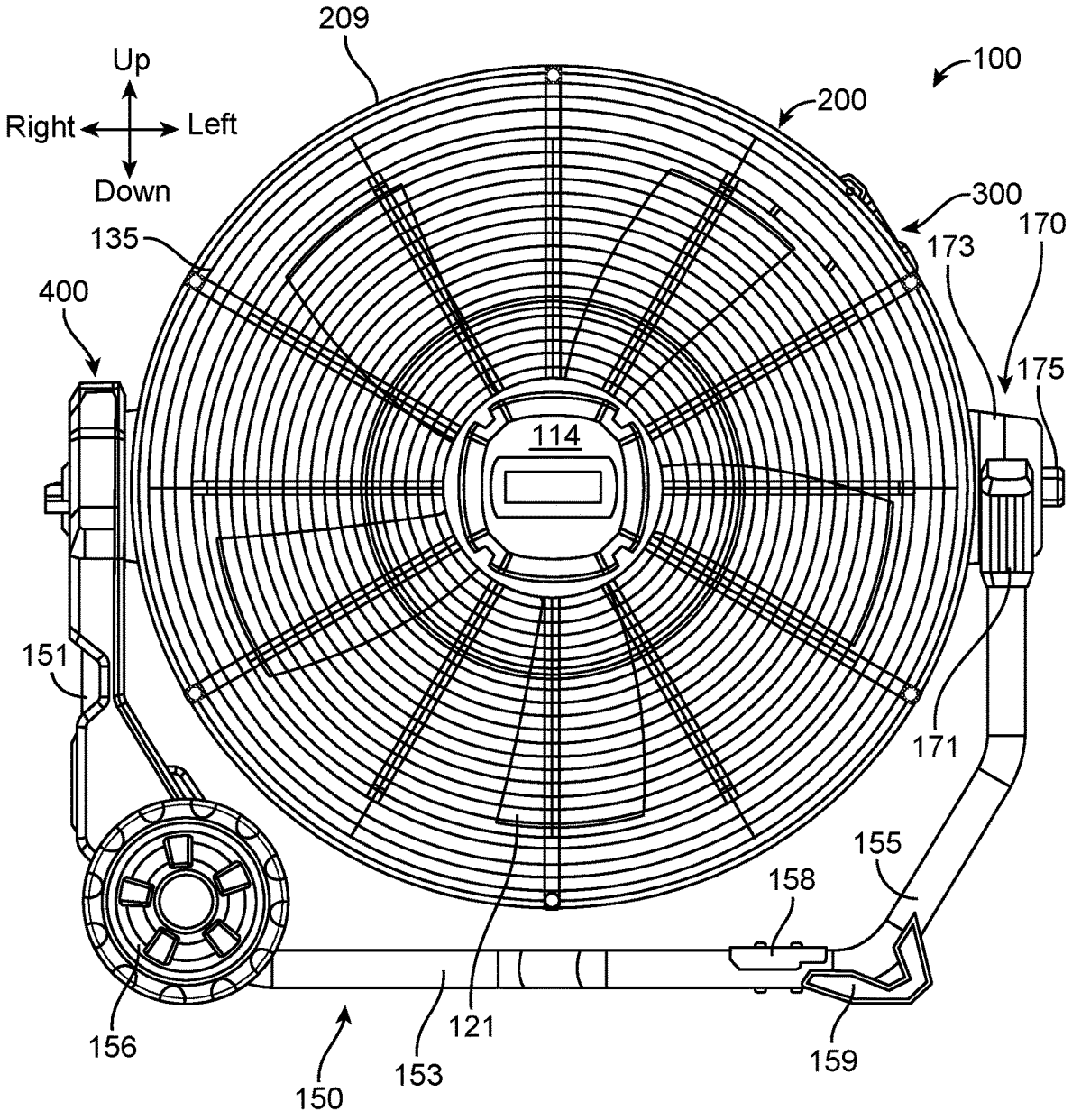
FIG. 4 shows a rear view of a fan assembly according to one or more embodiments.
Figure 5:
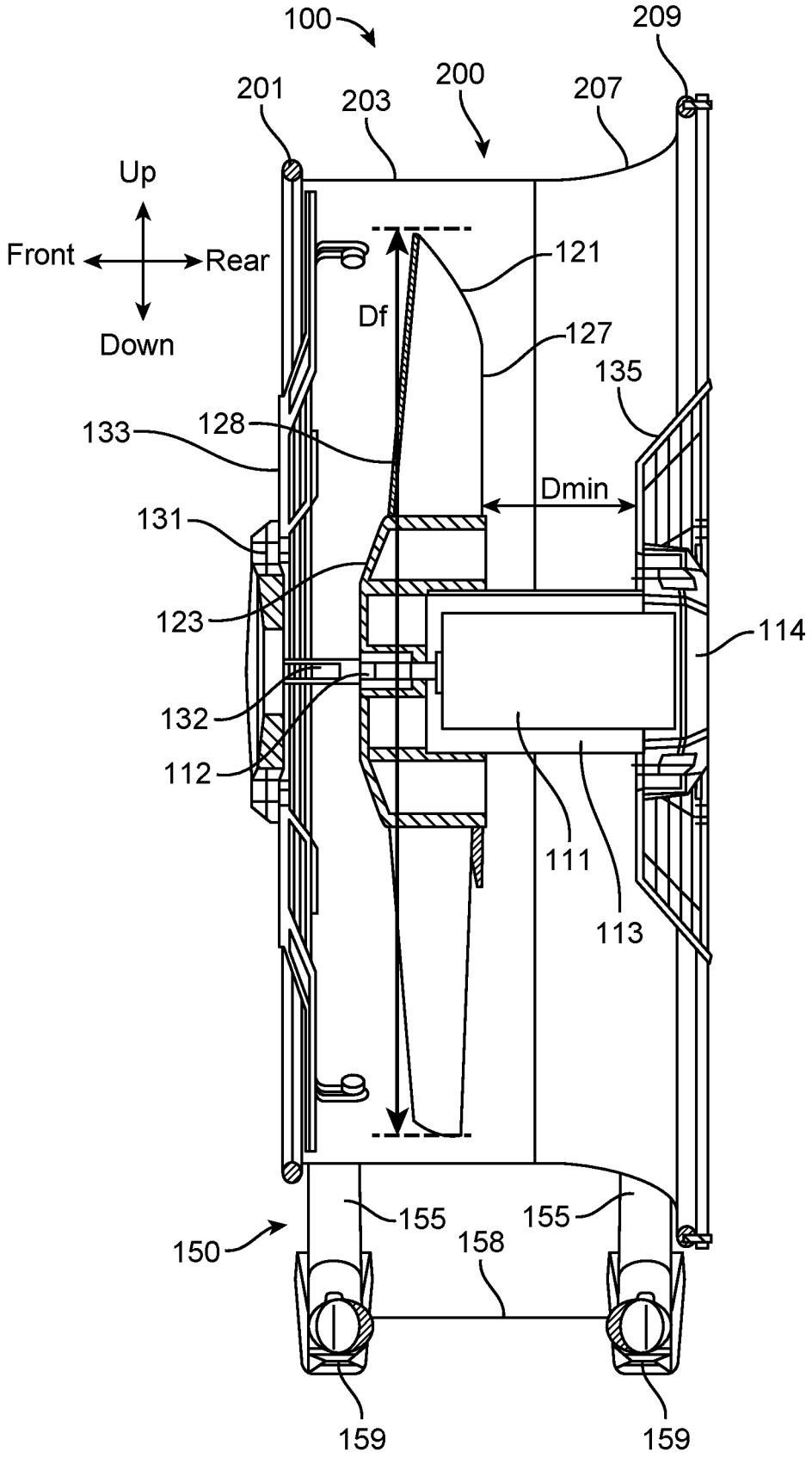
FIG. 5 shows a side cross-sectional view of a fan assembly according to one or more embodiments.

FIG. 1-2 show front and rear perspective views of a fan assembly 100 according to one or more embodiments, and FIGS. 3-4 show front and rear views of a fan assembly 100 according to one or more embodiments. FIG. 5 shows a side cross-sectional view of the fan assembly 100 according to one or more embodiments. As shown in FIGS. 1-5, the fan assembly 100 defines up and down vertical directions, right and left lateral directions, and front and rear axial directions. Below, the front direction may be alternatively be referred to as a forward direction. Referring to FIG. 5, the fan assembly 100 includes a motor 111. According to one or more embodiments, the motor 111 may be a brushed motor, a brushless motor, or other motors known for use in fans. As shown, the motor 111 may be partially disposed within a motor housing 113, and a rear-most portion of the motor 111 may be disposed within a rear cap 114 of the fan assembly 100. Alternatively, the motor 111 may be fully enclosed in the motor housing 113. According to one or more embodiments, the motor housing 113 and/or the rear cap 114 may be water-proof and/or dust-proof. The motor 111 includes an output shaft 112 that rotates about a rotation axis when actuated. According to one or more embodiments, the output shaft 112 extends from the motor 111 in a forward direction. A fan hub 123 is fixed to the output shaft 112 such that the fan hub 123 rotates with the output shaft 112 when the motor 111 is actuated and the output shaft 112 is thereby rotated. A plurality of fan blades 121 extend radially outward from the fan hub 123. While FIGS. 3-4 show the fan assembly 111 having five fan blades 121, the present disclosure is not limited thereto. The fan blades 121 are fixed to the fan hub 123 such that rotation of the fan hub 123 results in a rotation of the fan blades 121, and the rotation of the fan blades 121 generates airflow in the forward direction. According to one or more embodiments, the fan blades 121 are formed integrally with the fan hub 123. Alternatively, the fan blades 121 may be attached to the fan hub 123. The frontmost portion of the output shaft 112 may be rotatably supported by a retaining structure 132 that extends to a front cap 131 of the fan assembly 100. The motor 111, the output shaft 112, the fan hub 123, and the fan blades 121 may be collectively referred to as a fan of the fan assembly 100.

As shown in FIGS. 1-5, a fan shroud 200 is disposed around the fan blades 121. The fan shroud 200 surrounds the fan blades 121 to direct airflow from a rear of the fan assembly 100 to a front of the fan assembly 100. The fan shroud 200 is open at a front end and a rear end. A more detailed explanation of the fan shroud 200 will be set forth later. According to one or more embodiments, a front grill 133 is disposed on a front side of the fan shroud 200 and a rear grill 135 is disposed on a rear side of the fan shroud 200. The front grill 133 and the rear grill 135 allow airflow to pass therethrough while preventing users from coming in contact with the fan blades 121, and further prevents larger objects and debris that may damage the fan blades 121 and/or injure users from entering the fan blades 121. According to one or more embodiments, the front grill 133 and/or the rear grill 135 may be structured as a plurality of concentric circular wire structures and a plurality of radial wire structures connecting the circular wire structures. According to one or more embodiments, ends of some of the plurality of radial wire structures of the front grill 133 are secured to an inner surface of the fan shroud 200. According to one or more embodiments, a front cap 131 may be disposed at a center portion of the front grill 133, and a rear cap 114 may be disposed at a center portion of the rear grill 135. The front cap 131 may cover only the fan hub 123 or a portion thereof such that airflow from the fan blades 121 is not blocked thereby. The rear cap 114 may cover a rear of the motor 111 so as to not block or minimally block airflow intake through the rear of the fan assembly 100. The motor 111 may be supported on the rear grill 135 through the rear cap 114 and may be supported on the front grill 133 through the front cap 131, the retaining structure 132, and the output shaft 112 of the motor 111. The rear grill 135 may extend forward from rear end of the fan shroud 200 at a portion surrounding the rear cap 114 to provide support and rigidity to the rear cap 114 that supports a portion of the motor 111.

According to one or more embodiments, the fan assembly 100 includes a stand 150 that includes a pair of floor support portions 153, and a pair of right vertical portions 151 and a pair of left vertical portions 155 that extend upward from the floor support portions 153. The pair of right vertical portions 151 are joined at upper ends thereof to a battery receptacle assembly 400, and the pair of left vertical portions 155 are joined at upper ends thereof to a rotation lock assembly 170. Specifically, the upper ends of the pair of left vertical portions 155 may be inserted into and secured to support securing structures 171 of the rotation lock assembly 170 disposed on front and rear sides of a main body 173 of the rotation lock assembly 170. The main body 173 of the rotation lock assembly 170 is secured to a left side of the fan shroud 200, and a rotation lock dial 175 is disposed on an end surface of the main body 173. The upper ends of the pair of right vertical portions 151 may be inserted into and secured to the battery receptacle assembly 400. The battery receptacle assembly 400 is secured to a right side of the fan shroud 200. According to one or more embodiments, a cross-beam 158 extends between the pair of floor support portions 153 to provide rigidity to the stand 150. The ends of the cross-beam 158 may be fixed to upper surfaces of the floor support portions 153.

According to one or more embodiments, the fan shroud 200 may rotate with respect to the stand 150 about a lateral axis including the left and right directions, allowing the fan to be angled upwards and downwards. The stand 150 may further include a pair of wheels 156 that are connected via a wheel shaft that is rotatably disposed proximate to the junction of the floor support portions 153 and the right vertical portions 151. According to one or more embodiments, elbow supports 159 may be disposed at the transitions between the floor support portions 153 and the left vertical portions 155 such that, when the fan assembly 100 is sitting on the ground, the fan assembly 100 makes contact with the ground at the elbow supports 159 and the wheels 156. According to one or more embodiments, the elbow support 159 may be formed of a material that is softer, that is more elastic, and/or that is able to grip the ground compared to the material that makes up the floor support portions 153. According to one or more embodiments, the floor support portions 153, the right vertical portions 151, and the left vertical portions 155 are formed of metal, and the elbow supports 159 is formed of plastic and/or rubber.

Additionally, a handle 300, which will be described in further detail later, is disposed at a top left portion of the fan shroud 200. When a user lifts the fan assembly 100 via the handle 300, the elbow supports 159 are lifted off the ground such that only the wheels 156 contact the ground, and the wheels 156 allow a user to pull the fan assembly 100 in the left direction or push the fan assembly 100 in the right direction. The fan assembly 100 may further include weights (not shown) on the floor support portions 153 to anchor the fan assembly 100. The weights may be sleeve-shaped.

As shown in FIG. 5, each of the fan blades 121 have a leading edge 127 and a trailing edge 128, and there is a minimum distance Dmin in the axial directions between the leading edge 127 of the fan blades 121 and the frontmost portion of the rear grill 135. While keeping the minimum distance Dmin is generally desirable in forming a more compact fan assembly, Applicant has discovered that, when the minimum distance Dmin is 10% or greater than the fan diameter Df, there is a significant reduction in fan noise. The fan diameter Df is defined as a diameter of the fan, which may be determined as a diameter of a circle that includes the radial tips of each of the fan blades 121. According to one or more embodiments, a ratio between the minimum distance Dmin and the fan diameter Df is 10% or greater. According to one or more embodiments, a ratio between the minimum distance Dmin and the fan diameter Df is between 10% and 18%. According to one or more embodiments, a ratio between the minimum distance Dmin and the fan Fd diameter is between 15% and 18%. According to one or more embodiments, a ratio between the minimum distance Dmin and the fan diameter Df is between 16% and 17%. According to one or more embodiments, the minimum distance Dmin is greater than a minimum axial distance between the trailing edge 128 of the fan blades 121 and the front grill 133. According to one or more embodiments, the minimum distance Dmin is greater than a minimum axial distance between the leading edge 128 of the fan blades 121 and the front grill 133.

Figure 6A:
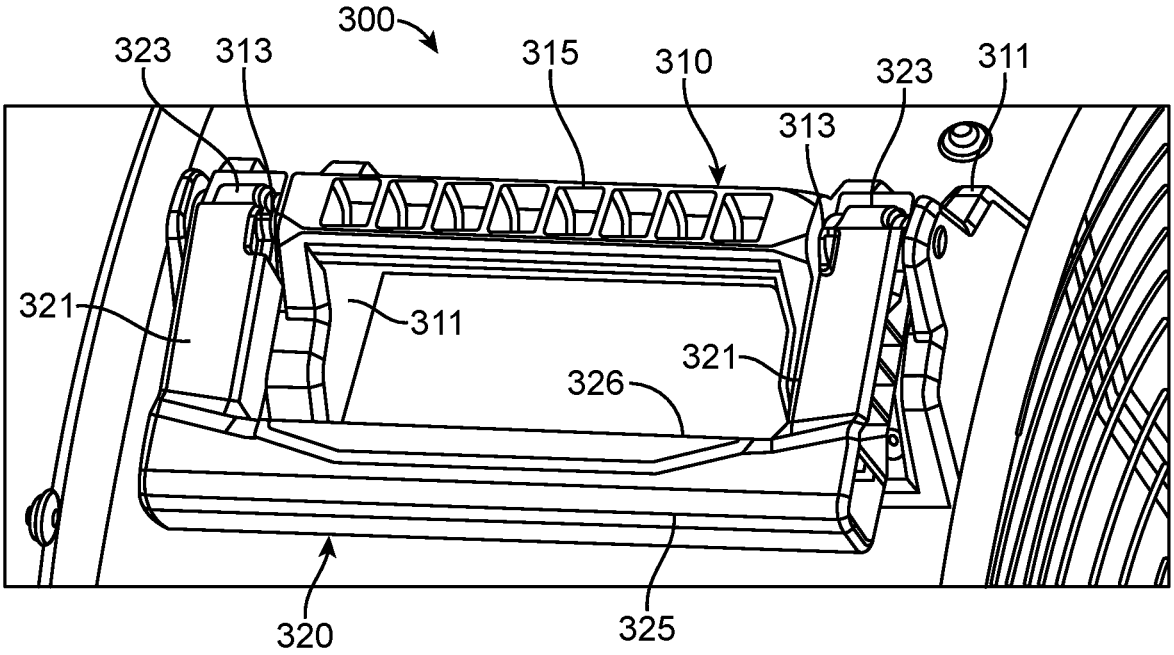
FIG. 6A shows a handle of a fan assembly in a lowered position according to one or more embodiments.
Figure 6B:
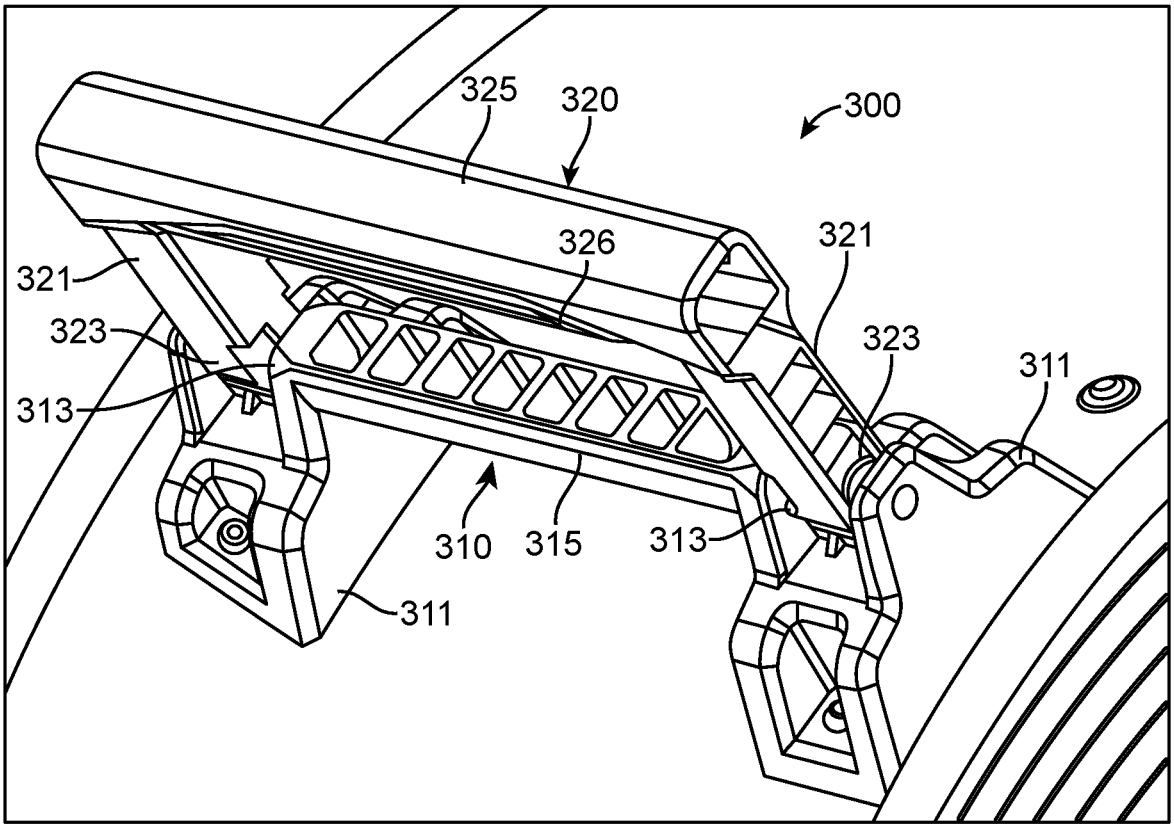
FIG. 6B shows a handle of a fan assembly in a raised position according to one or more embodiments.

FIG. 6A shows a handle 300 of a fan assembly 100 in a lowered position according to one or more embodiments, and FIG. 6B shows a handle 300 of a fan assembly 100 in a raised position according to one or more embodiments. The handle 300 may be disposed at a top left portion of the fan shroud 200 of the fan assembly 100. The handle 300 includes a base 310 and a rotating handle structure 320. The base 310 includes a pair of attachment portions 311 that are attached to an outer surface of the fan shroud 200 and a first gripping portion 315 extending between the attachment portions 311. There is a gap between the first gripping portion 315 and the fan shroud 200 such that a user can grip the first gripping portion 315 to lift and/or pull and/or push the fan assembly 100. The base 310 further includes first hinge portions 313. The rotating handle structure 320 includes second hinge portions 323 that are rotatably attached to the first hinge portions 313 of the base 310. The rotating handle structure 320 further includes a second gripping portion 325 and extension structures 321 that extend from the second hinge portions 323 to the second gripping portion 325. The second gripping portion 325 may include a molded grip 326 that is formed of a material that is softer and/or more elastic than the remainder of the second gripping portion 325 to enable easier gripping of the second gripping portion 325. The rotating handle structure 320 is structured such that the user may grip the second gripping portion 325 and pull the rotating handle structure 320 which rotates the rotating handle structure 320 with respect to the base 310, and the user can lift and/or pull and/or push the fan assembly 100 via the rotating handle structure 320 to move the fan assembly 100.

Figure 6C:
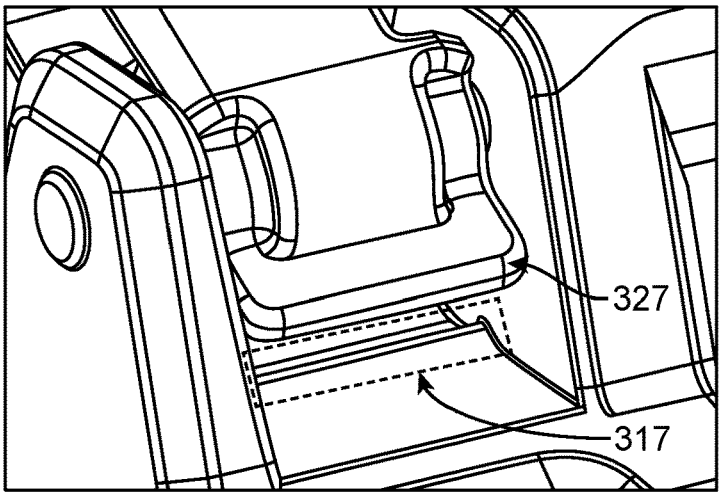
FIG. 6C shows detent structure of a handle of a fan assembly according to one or more embodiments.

FIG. 6C shows a detent structure of a handle 300 of a fan assembly 100 according to one or more embodiments. According to one or more embodiments, the rotating handle structure 320 includes a rib 327 and the base 310 includes a detent slot 317. As the rotating handle structure 320 rotates from the lowered position shown in FIG. 6A to the raised position shown in FIG. 6B, the rib 327 is pressed into the detent slot 317 to retain the rotating handle structure 320 in the raised position. The rib 327 may be removed from the detent slot 317 by the user rotating the rotating handle structure 320 with increased force.

Figure 7:
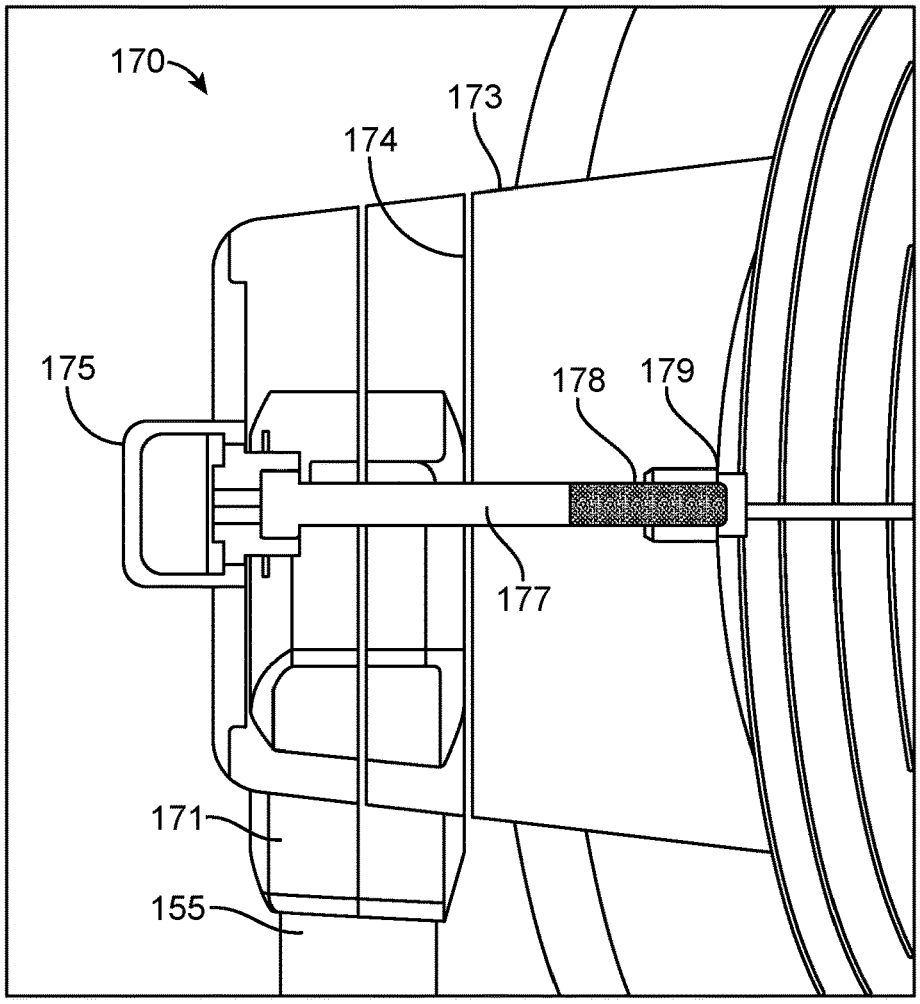
FIG. 7 shows a front cross-sectional view of a rotation locking mechanism of a fan assembly according to one or more embodiments.

FIG. 7 shows a rotation lock assembly 170 according to one or more embodiments. The rotation lock assembly 170 includes securing structures 171 into which upper ends of the pair of left vertical portions 155 may be inserted to secure the left vertical portions 155 to the support securing structures 171. The main body 173 of the rotation lock assembly 170 is secured to a left side of the fan shroud 200, and a rotation lock dial 175 is disposed on an end surface of the main body 173. The main body 173 may be divided into two parts with a friction plate 174 therebetween. The rotation lock dial 175 is fixed to a pin 177 with a threaded portion 178 that is screwed into a nut 179 fixed to the fan shroud 200. When the rotation lock dial 175 is rotated in a first direction, e.g., clockwise, the threaded portion 178 of the pin 177 is screwed into the nut 179, which compresses the two parts of the main body 173 onto the friction plate 174 and locks rotation of the fan shroud 200 about the stand 150. When the rotation lock dial 175 is rotated in a second direction, e.g., counterclockwise, the threaded portion 178 of the pin 177 is screwed out of the nut 179, which unlocks rotation of the fan shroud 200 about the stand 150.

Figure 8:
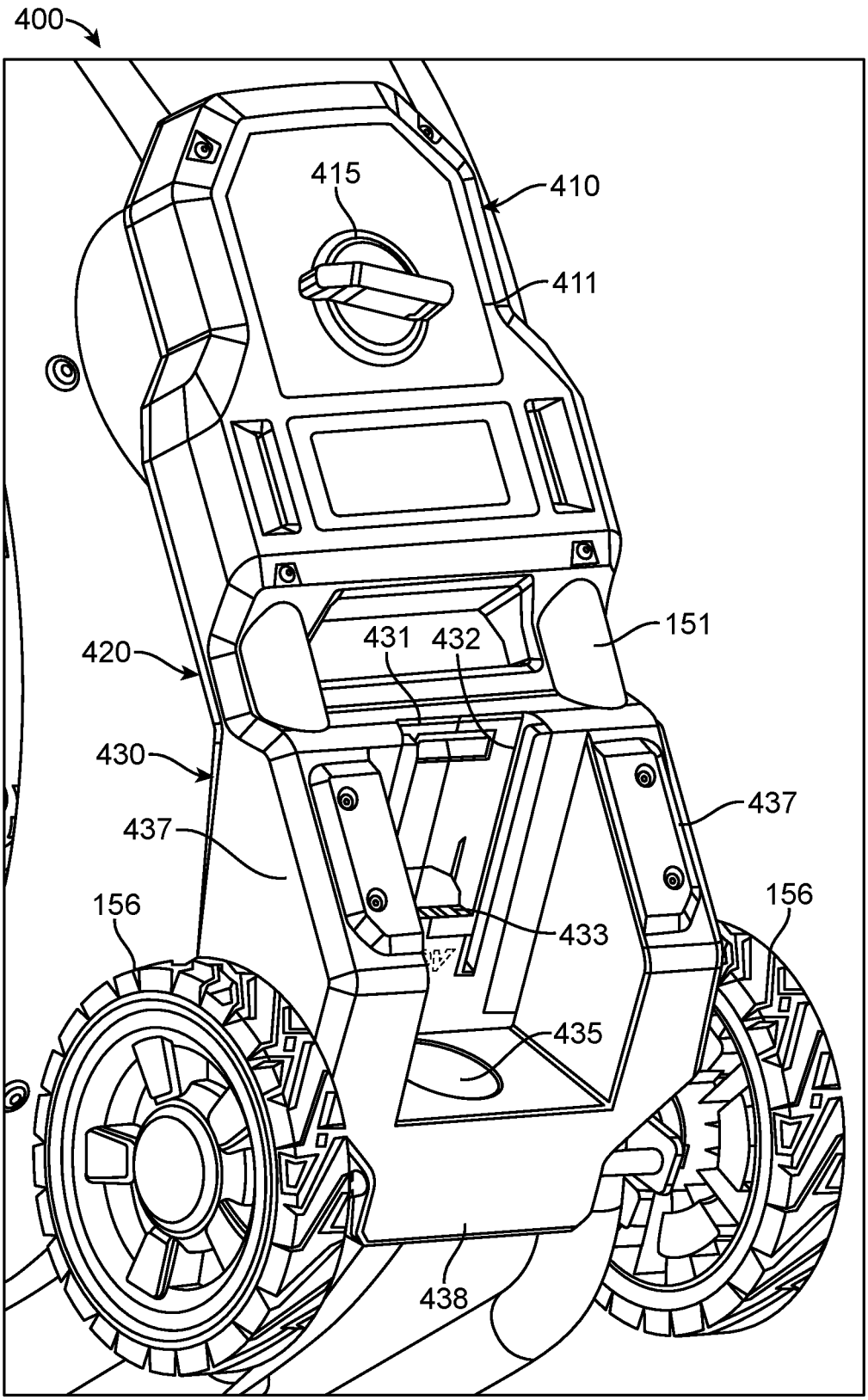
FIG. 8 shows a front perspective view of a battery receptacle assembly of a fan assembly according to one or more embodiments.
Figure 9:
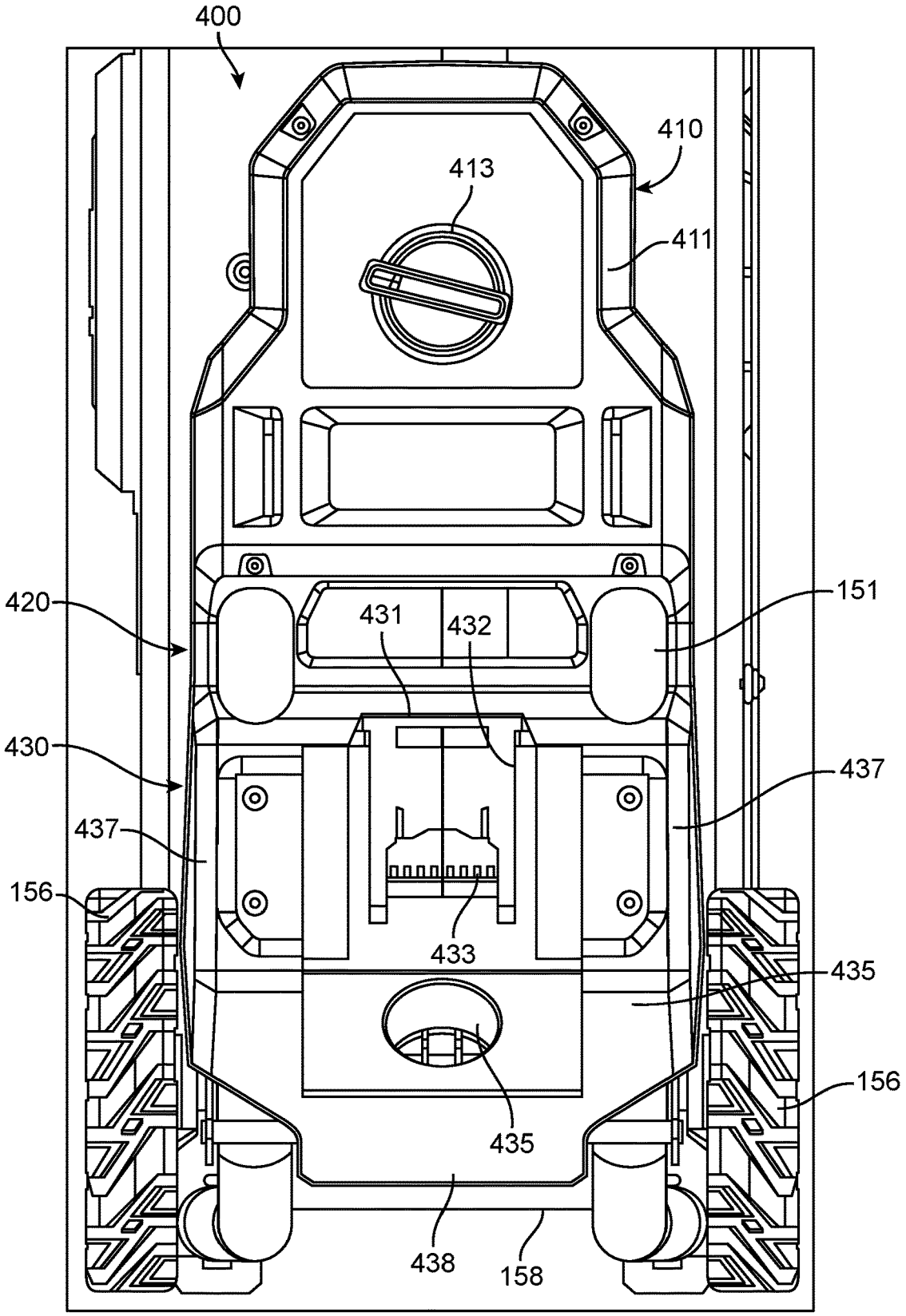
FIG. 9 shows a side view of a battery receptacle assembly of a fan assembly according to one or more embodiments.

FIG. 8 shows a front perspective view of a battery receptacle assembly 400 of a fan assembly 100 according to one or more embodiments, and FIG. 9 shows a side view of a battery receptacle assembly 400 of a fan assembly 100 according to one or more embodiments. The battery receptacle assembly 400 may include an upper portion 410, a lower portion 430, and a bridge portion 420 between the upper portion 410 and the lower portion 430. The upper portion 410 includes an upper housing 411 on which a speed control dial 415 is disposed. According to one or more embodiments, the speed control dial 415 may be rotated to turn the fan assembly 100 on and off and to adjust a rotational speed of the motor 111 and the fan blades 121 to adjust an air flow rate through the fan assembly 100. According to one or more embodiments, the upper housing 411 includes a printed circuit board assembly that may include circuitry to sense the rotational position of the speed control dial 415 and control the rotational speed of the motor 111 and the fan blades 121. Additionally, upper ends of the right vertical equations 151 may be inserted into and fixed to the upper housing 411.

According to one or more embodiments, the battery receptacle assembly 400 includes a lower portion 430 below the upper portion 410, and a bridge portion 420 extending between the upper portion 410 and the lower portion 430. The pair of right vertical portions 151 may be partially exposed on an outer side of the bridge portion. The lower portion 430 includes a battery receptacle 431, a wall 437 on each side of the battery receptacle 431, and a lower housing 438 that includes an electrical plug receptacle 435 below the battery receptacle 431. The electrical plug receptacle 435 is configured to accept an electrical plug to provide power to the motor 111 when one end of an electrical wire is plugged into the electrical plug receptacle 435 and the other end of the electrical wire is plugged into an electric outlet. The pair of right vertical portions 151 may pass through each of the walls 437. According to one or more embodiments, the battery receptacle 431 includes a guide rail portion 432 that accepts a slidable battery pack, and terminals 433 that electrically connect to corresponding terminals on the battery pack. Thus, the battery pack may provide power to the fan assembly 100 through the terminals 433. A printed circuit board assembly may be disposed in the lower portion 430 and connected to the terminal 433. Additionally, a wire may connect the printed circuit board to the motor 111 to drive the motor 111 when a battery pack is disposed on the battery receptacle 431. For example, the electrical wire may be attached to a back of the rear grill 135. According to one or more embodiments, the electrical plug receptacle 435 is positioned directly below the battery receptacle 431 such that only one of the battery pack and the electrical plug can be connected at one time.

When power is provided to the motor 111 from the battery pack on the battery receptacle 431 or from the electrical plug on the electrical plug receptacle, the fan blades 121 rotate to generate airflow from the rear side of the fan assembly 100 to the front side of the fan assembly 100. As such, the fan shroud 200 will be described in airflow order from the rear end thereof to the front end thereof. According to one or more embodiments, the fan shroud 200 may include a rear lip 209 at a rearmost end of the fan shroud 200, a converging section 207 extending forward from the rear lip 209 that gradually decreases in diameter towards the front, a constant diameter section 203 extending forward from the converging section 207, and a front lip 201 at a frontmost end of the fan shroud 200. As shown in FIG. 5, the converging section 207 may have a curved profile from the rear lip 209 to the constant diameter section 203. The front and rear lips 201, 209 may provide stiffness to the front and rear ends of the fan shroud 200 and may further blunt the front and rear ends of the fan shroud 200 so that they do not injure a user. Both the inner and outer diameters of the fan shroud 200 decrease in diameter in the converging section 207 in the forward direction.

As shown in FIG. 5, the fan blades 121 may be disposed within the constant diameter section 203 of the fan shroud 200. Thus, rotation of the fan blades 121 pulls airflow from a rear of the fan shroud 200 through the converging section 207 to the constant diameter section 203, and the airflow through the constant diameter section 203 exits a front of the fan shroud 200. The decrease in diameter in the airflow direction via the converging section 207 provides improvement in performance.

Figure 10:
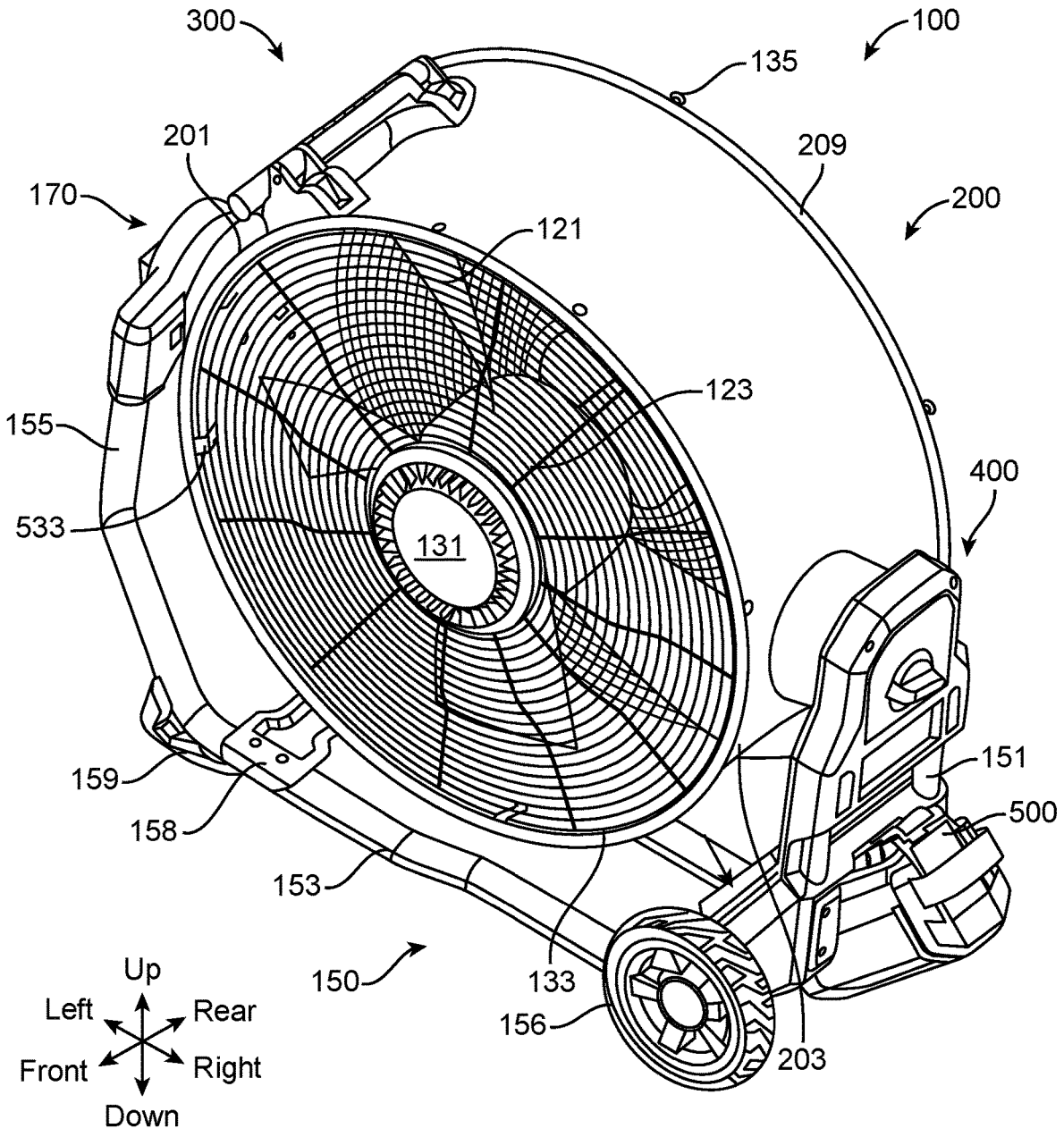
FIG. 10 shows a front perspective view of a fan assembly according to one or more embodiments.
Figure 11:
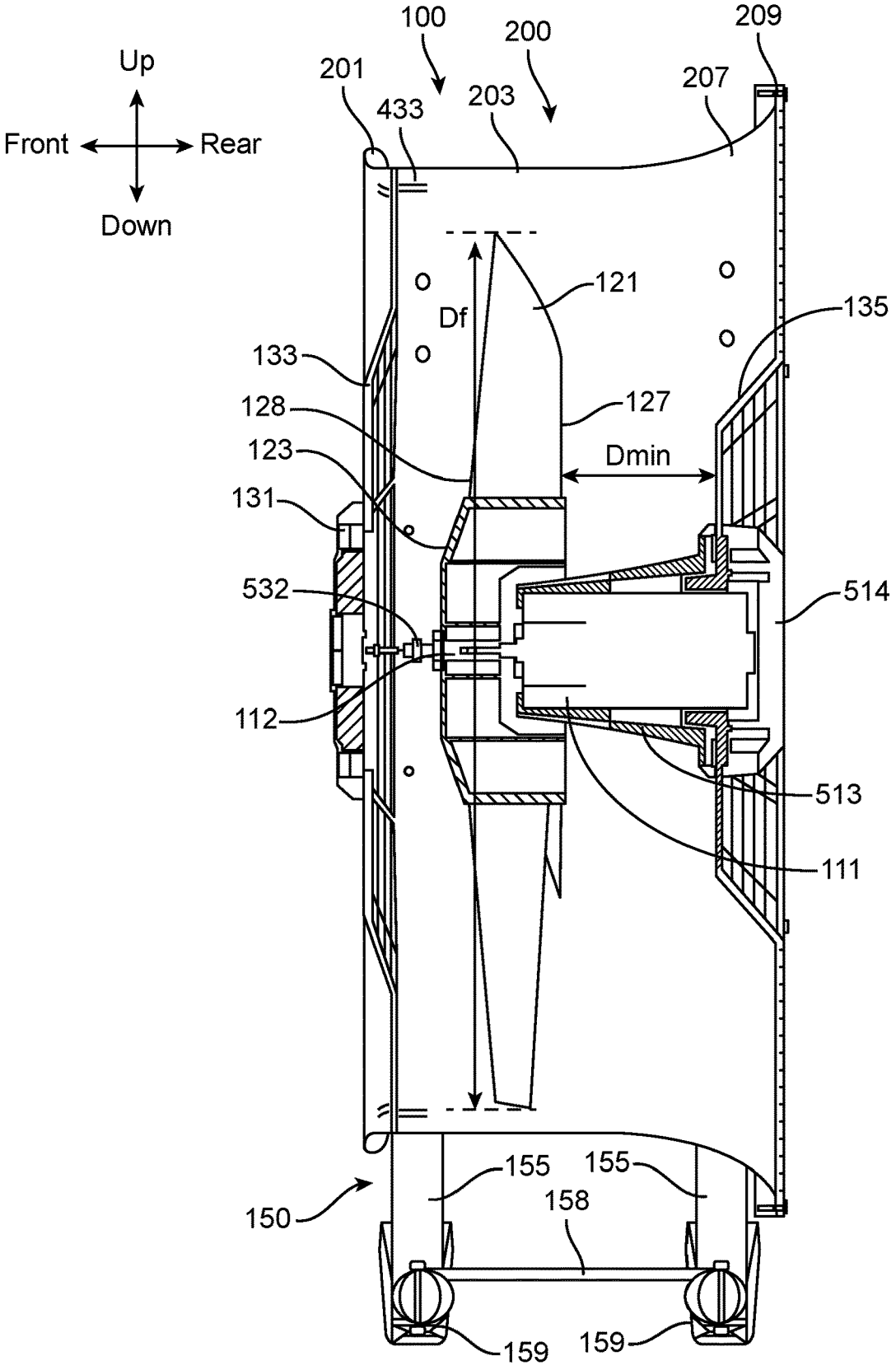
FIG. 11 shows a side cross-sectional view of a fan assembly according to one or more embodiments.

FIG. 10 shows a front perspective view of a fan assembly 100 according to one or more embodiments, and FIG. 11 shows a side cross-sectional view of a fan assembly 100 according to one or more embodiments. The fan assembly 100 shown in FIGS. 10-11 are similar to that shown in FIGS. 1-9. Thus, the descriptions of the portions that are similar are not repeated.]

As explained above with reference to FIGS. 8-9, the battery receptacle assembly 400 has a lower portion 430 that includes a battery receptacle 431. FIG. 10 shows a slidable battery pack 500 disposed in the battery receptacle 431.

In the fan assembly 100 shown in FIGS. 1-9, the ends of some of the plurality of radial wire structures of the front grill 133 are secured to an inner surface of the fan shroud 200. In contrast, according to one or more embodiments, the fan assembly 100 shown in FIGS. 10-11 includes grill securing brackets 533 that secure the outermost circular wire structure of the plurality of concentric circular wire structures of the front grill 133 to an inner surface of the fan shroud 200.

In the fan assembly 100 shown in FIGS. 1-9, the frontmost portion of the output shaft 112 may be rotatably supported by a retaining structure 132 that extends to a front cap 131 of the fan assembly 100. In contrast, according to one or more embodiments, the fan assembly 100 shown in FIGS. 10-11 includes a shaft securing structure 532 that secures the frontmost portion of the output shaft 112 to the fan hub 123 without extending to the front cap 131.

In the fan assembly 100 shown in FIGS. 1-9, the motor housing 113 has a constant diameter from a front end thereof to a rear end thereof. In contrast, according to one or more embodiments, the fan assembly 100 shown in FIGS. 10-11 includes a motor housing 513 that increases in diameter from a front end to a rear end such that the motor housing 513 has a larger diameter than the motor housing 113. As such, the fan assembly 100 shown in FIGS. 10-11 has a rear cap 514 that is significantly larger in diameter than the rear cap 114 shown in FIGS. 10-11. The larger rear cap 514 provides more support for the motor 111.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A fan assembly comprising:

a motor having an output shaft that defines a rotation axis;

a plurality of fan blades coupled to the output shaft and configured to be rotated by the output shaft when the motor is actuated to generate airflow;

a fan shroud surrounding the plurality of fan blades; and a handle disposed on the fan shroud, wherein the handle comprises a base and a rotating handle structure rotatable about the base between a lowered position and a raised position, and wherein the base comprises a first gripping portion configured to be gripped by a user, and the rotating handle structure is rotatably coupled to opposite ends of the first gripping portion and comprises a second gripping portion configured to be gripped by the user, wherein the first gripping portion and the second gripping portion extend in a direction parallel to the rotation axis, wherein, in the lowered position, the first gripping portion and the second gripping portion are equidistant from the rotation axis, wherein, in the raised position, the second gripping portion is farther away from the rotation axis than the first gripping portion, and wherein the handle comprises a detent structure configured to retain the rotating handle structure in the raised position.

2. The fan assembly of claim 1, wherein the fan assembly defines an upward direction and a downward direction, and wherein the handle is disposed on the fan shroud at a position in the upward direction from the rotation axis.

3. The fan assembly of claim 2, wherein the fan assembly defines a rightward direction and a leftward direction, wherein the handle is disposed on the fan shroud at a position in one of the rightward direction and the leftward direction from the rotation axis, wherein at least one wheel is positioned in the downward direction from the rotation axis and the other of the rightward and leftward direction from the rotation axis.

4. The fan assembly of claim 1, wherein the detent structure comprises a rib disposed on one of the rotating handle structure and the base and a detent slot disposed on the other of the rotating handle structure and the base, and wherein, in the raised position, the rib is inserted into detent slot.

* * * * *